US005765512A

United States Patent [19]

Fraser

[11] Patent Number: 5,765,512

[45] Date of Patent: Jun. 16, 1998

[54] ROTARY-LINEAR POWER DEVICE

[76] Inventor: Burt Loren Fraser, 217 E. 10th St. #10, Davenport, Iowa 52803

[21] Appl. No.: 788,238

[22] Filed: Jan. 25, 1997

[51] Int. Cl.[6] ..... F02B 75/26

[52] U.S. Cl. ..... 123/54.1; 123/54.3; 123/56.1

[58] Field of Search ..... 123/54.1, 54.2, 123/54.3, 56.1

[56] References Cited

U.S. PATENT DOCUMENTS

| | | | |
|---|---|---|---|
| 998,363 | 7/1911 | Lukacsevics . | |
| 1,177,126 | 3/1916 | Miller . | |
| 1,261,111 | 4/1918 | Fasey et al. . | |
| 1,545,925 | 7/1925 | Powell . | |
| 2,265,171 | 12/1941 | Johnson | 123/54.3 |
| 2,384,292 | 9/1945 | Feroy | 123/56.1 |
| 2,401,466 | 6/1946 | Davis et al. . | |
| 3,078,832 | 2/1963 | Braine | 123/56.1 |
| 3,403,668 | 10/1968 | Schottler . | |
| 3,572,209 | 3/1971 | Aldridge et al. | 123/54.3 |
| 5,146,880 | 9/1992 | Mayne | 123/554 |
| 5,209,190 | 5/1993 | Paul | 123/43 AA |
| 5,218,933 | 6/1993 | Ehrlich | 123/56 C |
| 5,357,843 | 10/1994 | Errante | 91/491 |
| 5,357,911 | 10/1994 | Lindblad | 123/54.3 |
| 5,462,363 | 10/1995 | Brinkman | 384/91 |
| 5,517,953 | 5/1996 | Wiesen | 123/557 |
| 5,553,574 | 9/1996 | Duncalf | 123/54.3 |

*Primary Examiner*—David A. Okonsky

[57] ABSTRACT

Apparatus for converting between rotary motion and reciprocating linear motion includes a sleeve mounted for rotation about a predetermined axis, radially reciprocable pistons located radially outwardly of the sleeve, and axially reciprocable pistons located radially inwardly of the sleeve. The radial pistons are operatively connected to an outer diameter portion of the sleeve which is formed with a lobed cam surface having multiple angularly spaced lobes for simultaneous reciprocation of the radial pistons and rotation of the sleeve, and the axial pistons are operatively connected to a groove formed in the inside diameter portion of the sleeve for simultaneous reciprocation of the axial pistons and rotation of the sleeve. Power input may be provided by a rotationally driven shaft assembly which is operably connected to the sleeve for rotation of the sleeve such as by the provision of a second groove which is formed in the shaft assembly and which is shaped to compliment the groove of the sleeve for reciprocably driving the axial pistons. Alternately, a predetermined number of pistons may be adapted for the combustion of a fuel, the remaining pistons being operable to, for example, pump a fluid and the shaft being capable of providing rotary output, thus enabling operation as an engine, a pump, a compressor, or like machinery, or as a combination thereof.

23 Claims, 10 Drawing Sheets

ROTARY-LINEAR POWER DEVICE

BACKGROUND OF THE INVENTION

This invention relates generally to machines which utilize or require reciprocating linear motion such as is typically associated with reciprocating pistons.

More specifically, the invention relates to conversion between reciprocating linear motion and rotary motion such as is useful in internal combustion engines, compressors, pumps, and like machines, and to apparatus for operatively connecting the reciprocating pistons for power transmission purposes.

Traditionally, internal combustion engines, for example, utilize a crank and connecting rod arrangement to convert the reciprocating linear motion of multiple pistons into rotary power at an output shaft. Similarly, many prior pumps and compressors utilize such an arrangement to convert rotary input into reciprocating linear piston motion to effect compression and/or pumping of a fluid. Such an arrangement, while operable and well-known in the art, is also encumbered with equally well-known disadvantages. As a result, the art is replete with alternate designs for engines, pumps, and compressors utilizing various arrangements to convert between the linear motion of reciprocating axial or rotary pistons and the rotation of a shaft for the purpose of improving on the traditional crank/connecting rod arrangement. While certain machines of the prior art have improved on the basic crank/connecting rod arrangement, there is an ever present need to increase efficiency and/or capacity of a machine of a given size, and/or to reduce the size of the machine for particular operating parameters.

SUMMARY OF THE INVENTION

A general aim of the present invention is to provide new and improved apparatus for converting between rotary motion and reciprocating linear motion, the device thus being adaptable for use in internal combustion engines, compressors, pumps and like machines; the apparatus being uniquely adapted to increase capacity/efficiency for a given size of machine and thus being able to reduce the size of the machine for particular operating parameters.

Another aim of the invention is to provide new and improved apparatus for operatively connecting radially reciprocable pistons and axially reciprocable pistons.

Still another aim is to provide such apparatus adaptable for simultaneous operation as any two or three of, for example, an engine, a compressor, or a pump.

A detailed objective of the invention is to achieve the foregoing by providing multiple radial pistons radially disposed of and operatively coupled with a rotatable member.

Another detailed objective of the invention is to provide multiple axial pistons angularly spaced on a predetermined diameter, multiple radial pistons radially disposed of the axial pistons and spaced longitudinally with respect to the axial pistons, and apparatus for operatively connecting the pistons.

A more detailed objective is to achieve the foregoing by way of a rotatable sleeve disposed between and operably coupling the radial pistons and the axial pistons for simultaneous reciprocation of the piston and rotation of the sleeve.

Still another detailed objective is to provide a rotatable shaft adapted to reciprocate the axial pistons.

These and other objectives and advantages of the invention will become more apparent from the following detailed description when taken in conjunction with the accompanying drawings.

In one embodiment, the apparatus of the present invention includes an input/output shaft assembly mounted for rotation about a predetermined axis, a plurality of axial pistons spaced radially outwardly of and operatively connected to the shaft assembly, each axial piston being slidably disposed in an axially extending cylinder and dividing the cylinder into two variable volume chambers at the end portions thereof, a plurality of radial pistons spaced radially outwardly from and longitudinally along the axial pistons, each radial piston being slidably disposed in a radially extending cylinder so as to define a variable volume chamber in the outer end thereof, and a rotatable sleeve member disposed between and operatively connecting the radial and axial pistons. The chambers defined by the radial and axial pistons are connected to a control manifold for control of fluid into and out of the chambers.

The outside diameter portion of the sleeve is formed with an axially extending lobed profile which repeats upon progressing angularly or circumferentially around the sleeve, and each radial piston includes a wheel which is maintained in rolling contact with the lobed surface of the sleeve. As a result, radial reciprocation of the pistons occurs simultaneously with rotation of the sleeve. Each axial piston includes a drive pin which extends radially into and is slidably located within a groove or track formed in the inside diameter of the sleeve. The track extends generally circumferentially and defines a sinusoidal or Fourier shaped track if unrolled and laid out flat. The drive pins also extend radially into a complimentary and similarly shaped track formed into the outside diameter portion of the shaft assembly. Thus, the drive pins slide along the complimentary tracks, and axial reciprocation of the axial pistons occurs simultaneously with rotation of the sleeve and/or the shaft assembly.

With this general arrangement, the apparatus is adaptable for use in, for example, an electric motor driven pump. In such a pump, the shaft assembly is coupled to the electric motor. The axial pistons reciprocate responsive to the drive pins in the track of the rotating shaft assembly, the sleeve rotates responsive to the outer drive pin in the track formed in the sleeve, and the radial pistons reciprocate in response to the rotating lobed surfaces of the sleeve. Thus, with the variable volume chambers in communication with appropriately timed valves in the control manifold, the pistons are operable to pump fluid as the shaft assembly is driven by the electric motor. As will be apparent from the following description, this is but one of the useful and unique embodiments of the apparatus of the present invention.

Figure 1:
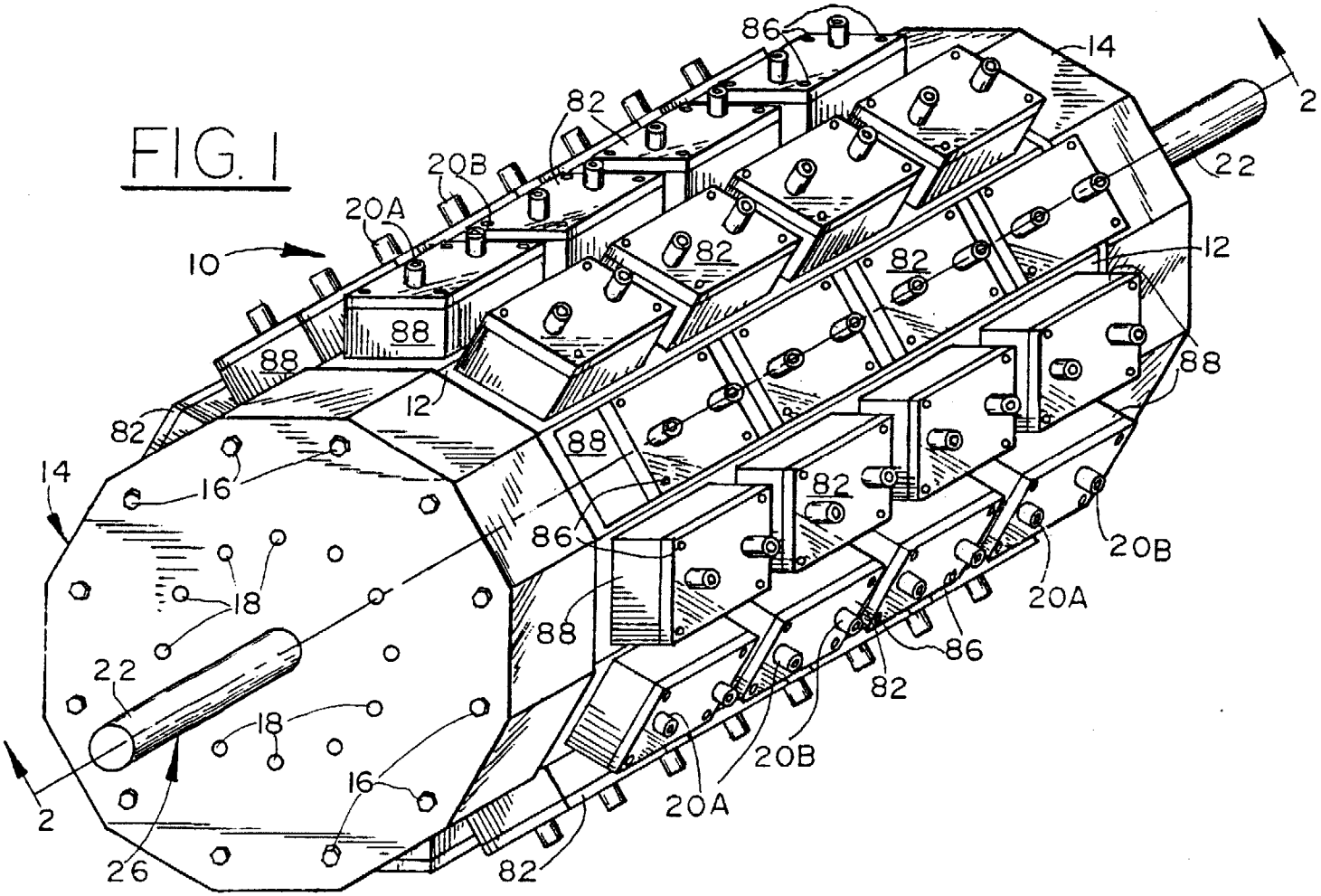
FIG. 1 is a perspective view of a new and improved pump which embodies the apparatus of the present invention.

While the invention is susceptible of various modifications and alternative constructions, certain illustrated embodiments have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the invention.

DETAILED DESCRIPTION OF THE INVENTION

For purposes of illustration, the present invention is shown in the drawings as embodied in a pump 10 (FIG. 1) adapted to be driven by, for example, an electric motor (not shown) and adapted for use in pumping, for example, room temperature fluids.

The pump 10 includes a generally cylindrical housing 12 and end caps 14 secured to the ends of the housing by screws 16. Ports 18, 20A, 20B are connected to, for example, a control manifold (not shown) for controlling the flow of the fluid into and out of the pump. An input shaft assembly 26 is journaled for rotation in the housing and includes an input shaft 22 mounted in bearings 24. The electric motor is coupled to the input shaft for providing rotary power to the pump.

In accordance with the present invention, the pump 10 is uniquely adapted such that very little internal space is required for converting the rotary energy or torque of the input shaft 22 into reciprocating linear piston motion for pumping a fluid. As a result, the efficiency of the pump is relatively high in that the pump is operable to transfer a substantial volume of fluid for a given overall size.

In general, a first rotatable sleeve 28 telescopes over the shaft 22, is operably connected to the shaft for rotation as the shaft rotates, and is operably connected to axial pistons 30 in a torque transmitting connection for reciprocation of the pistons. A second rotatable sleeve 32 telescopes over the axial pistons, is operably coupled to the axial pistons for rotation as the axial pistons reciprocate, and is operably connected to radial pistons 34 for reciprocating the radial pistons as the sleeve 32 rotates.

The shaft assembly 26 includes the shaft 22, the sleeve 28, and a speed reducing mechanism operably coupled therebetween. In the embodiment shown, speed reduction is accomplished by a mechanism of the type generally disclosed in Brinkman U.S. Pat. No. 5,462,363, entitled "Scroller Roller Band Device". Specifically, the shaft assembly 26 includes four rods 36 which are parallel to and equally spaced about the axis of the shaft 22, and four continuous flexible drive bands or belts 38 spaced longitudinally from one another along the length of the rods and interconnecting the shaft and the rods as described in the Brinkman Patent. The sleeve 28 telescopes over the rods in frictional engagement with the bands such that the sleeve is rotationally driven by the bands as the shaft rotates. Although any suitable speed reducing mechanism may be utilized for driving the sleeve, the bands drive the sleeve with relatively low friction and absorb or dampen the forces on the sleeve caused by the reciprocating operation of the axial pistons.

In the present instance, pins 27 extend inwardly from the end caps 14 and are slidably received into ball bearings or bushings 29 centrally located in the end portions of the rods 36 to prevent revolution of the rods around the shaft 22 while allowing for rotation of the rods. The bushings are surrounded by, for example, a wave spring or a resilient rubber gasket 31 to provide limited translation of a rod about the center of the pin. Thus, the mounting arrangement for the rods are somewhat flexible to accommodate the potentially changing thickness of the drive bands 38.

The axial pistons 30 are slidably disposed in axially extending cylinders 40 to provide for two opposing variable volume chambers 42 (see FIG. 3), the chambers being located in the end portions of the cylinders. The ends of the pistons may be equipped with a seal mechanism such as a Teflon seal ring 44 for sealing the internal ends of the chambers, or with other seal arrangements suitable for specific operating temperatures, fluid resistance parameters, or other operating conditions.

The axial cylinders 40 are arranged in proximate, parallel relationship with and radially outwardly of the sleeve 28, and are angularly and equally spaced on a predetermined diameter. To maximize pumping capacity of the axial pistons 30, the cylinders 40 are preferably sized to utilize substantially all of the space between the sleeves 28 and 32. The cylinders 40 are secured in position in the housing 12 by, for example, being clamped in and between inwardly opening counterbores 46 in the end caps 14. Provision may be made for sealing the junction between the ends of the cylinders and the counterbores such as by adapting the junction in well known techniques to accept a suitable seal (not shown) or to seal the potential leak path with, for example, a silicone-based sealant.

In the embodiment shown, individual ports 18 are provided though the end caps 14 for communication between the axial chambers 42 and the control manifold which is adapted in a conventional manner to selectively control input and output from the cylinders in timed relation with the stroke of the axial pistons 30. Alternately, the chambers 42 may be equipped with both inlet and outlet ports connected to the manifold.

Figure 6:
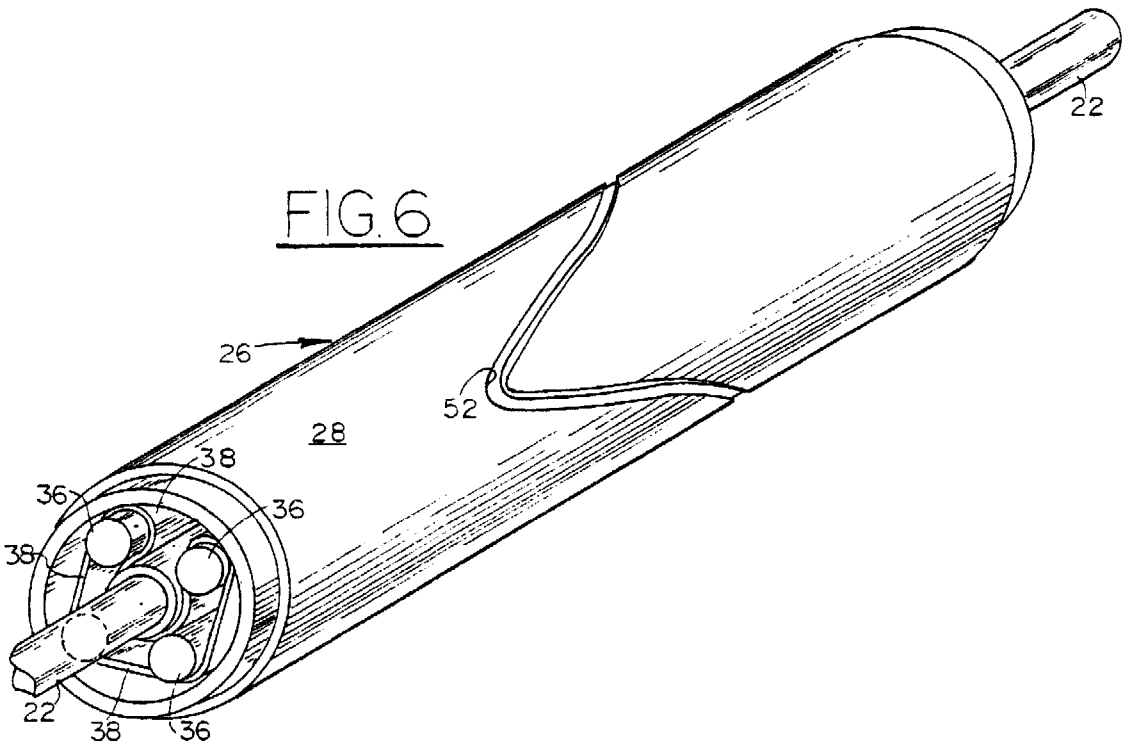
Figure 12:
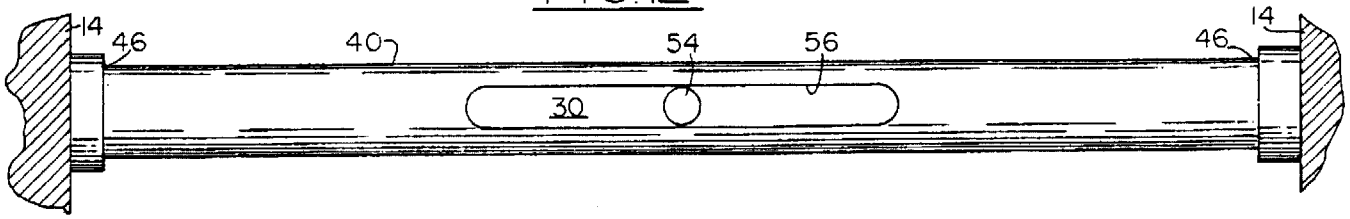
FIG. 12 is a view taken substantially along the line 12—12 of FIG. 8.
Figure 10:
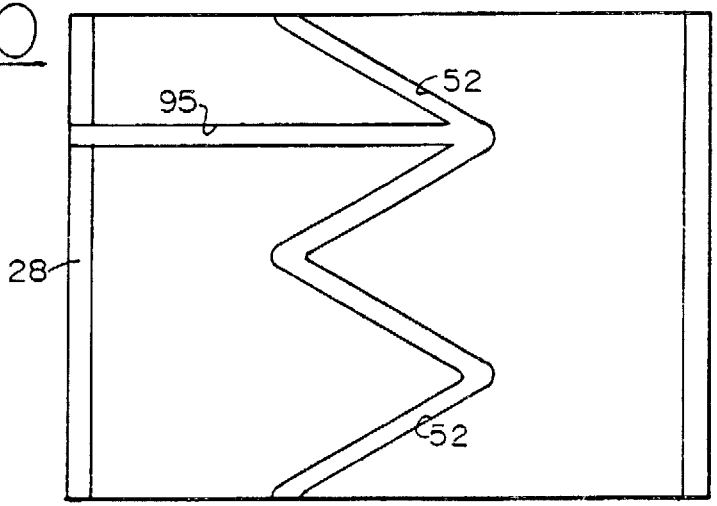
FIGS. 9 and 10 are views of certain cylindrical surfaces of parts shown in FIGS. 5 and 6, respectively, the surfaces being shown as if split and laid flat.

In carrying out one aspect of the invention, a cam groove or track 52 (FIG. 6) is formed in the outer diameter of the sleeve 28. The axial pistons 30 are equipped with guide pins 54 which extend radially inwardly from the center of the pistons, through axially extending slots 56 (see FIG. 12) formed into the cylinders 40, and slidably into the track 52. In general, the track is adapted to cause reciprocation of the axial pistons as the sleeve rotates. As shown best in FIG. 10, the outer diameter of the sleeve 28 being shown as split and unrolled flat, the track extends continuously around the sleeve, and is preferably formed with a generally sinusoidal or Fourier shape. With the track configured as shown, each piston will complete 2 pumping cycles during each revolution of the sleeve. The slots 56 are of sufficient length to allow for stroking of the piston but are sized so that the seals 44 do not pass the ends of the slot 56 at the ends of the piston stroke so as to prevent the creation of a leak path from the chambers 42.

Bearings 58 located at the ends of the sleeve 28 react the thrust forces on the sleeve into the end caps 14 as the guide pins 54 slide in the track 52. A cam roller (not shown) of the type which is commercially available may be optionally located at the end of the guide pin and journaled for rotation about the axis of the pin to provide for rolling engagement with the side of the track 52 to reduce the friction as the piston reciprocates. Advantageously, the mass or rotational energy of the rotating sleeve 28 acts as a flywheel to smooth the intermittent and pulsating forces resulting from reciprocably driving the axial pistons and pumping fluid through the chambers 42.

In accordance with another aspect of the invention, the sleeve 32 is operably connected between the axial pistons 30 and the radial pistons 34 such that (1) the sleeve is rotated by the reciprocating axial pistons 30 and (2) the rotating sleeve 32 causes the radial pistons 34 to reciprocate for pumping additional fluid.

Figure 9:
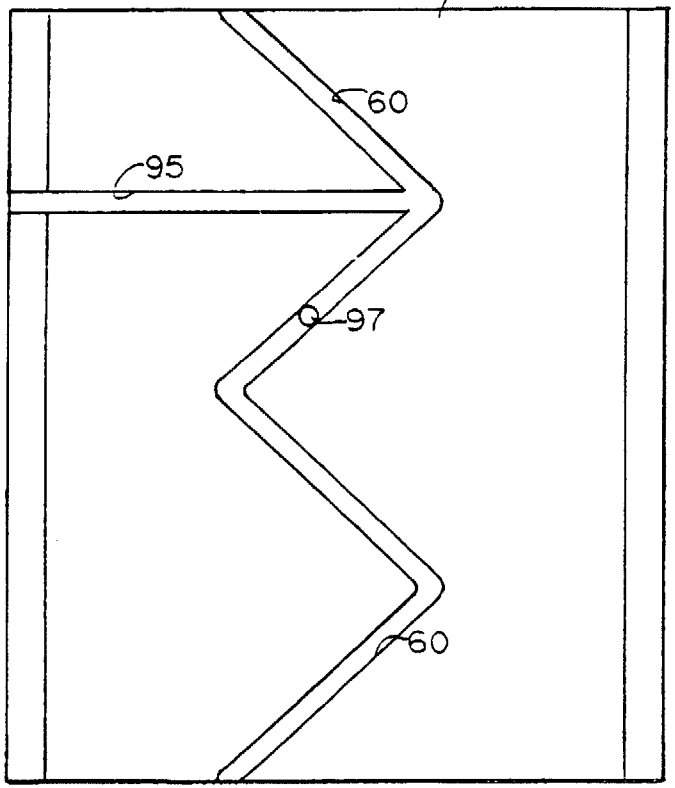

More specifically, the guide pins 54 extend radially outwardly from the axial pistons 30 through the slots 56 and slidably into a track 60 which is formed in the inside diameter portion of the sleeve 32. As best shown in FIG. 9, the inside diameter of the sleeve 32 being shown split and laid out flat, the track 60 extends continuously around the inside of the sleeve and is preferably formed with a generally sinusoidal or Fourier shape. Bearings 62 react the thrust forces on the sleeve and generally support the sleeve 32 for rotation about the axis of the shaft 22. Thus, as the axial pistons reciprocate, the guide pins acting in the track 60 cause the sleeve 32 to rotate.

The track 60 shown is adapted to provide for one revolution of the sleeve 32 for every two working strokes of the axial pistons 30. In this instance, one revolution of the sleeve 28 will result in one revolution of the sleeve 32. Alternately, the track 60 may be adapted for either faster or slower relative rotation by decreasing or increasing, respectively, the number of axial pumping cycles per revolution of the sleeve 32.

In further carrying out the invention, the outside diameter portion of the sleeve 32 is formed with a profiled cam surface which is operably connected to the radial pistons 34 for radial reciprocation of the pistons. More specifically, the outer surface of the sleeve is formed with a profile having angularly and circumferentially spaced lobes 64 and having complimentary valleys 66 formed between the lobes such as would be defined by a sinusoidal or Fourier shaped curve.

Each radial piston 34 is operably connected to the outer surface of the sleeve 32 in the embodiment shown by a radially inwardly directed biasing force which maintains an arrangement of the Brinkman Patent, or simply a roller or wheel 68 mounted to the base of the piston in rolling contact with the outer periphery of the sleeve. The wheel rolls in a groove or track 70 formed in the periphery of the sleeve and in a plane extending laterally through the sleeve. The tracks are formed with the lobed profile and are axially spaced for alignment with the radial pistons.

Figure 7:
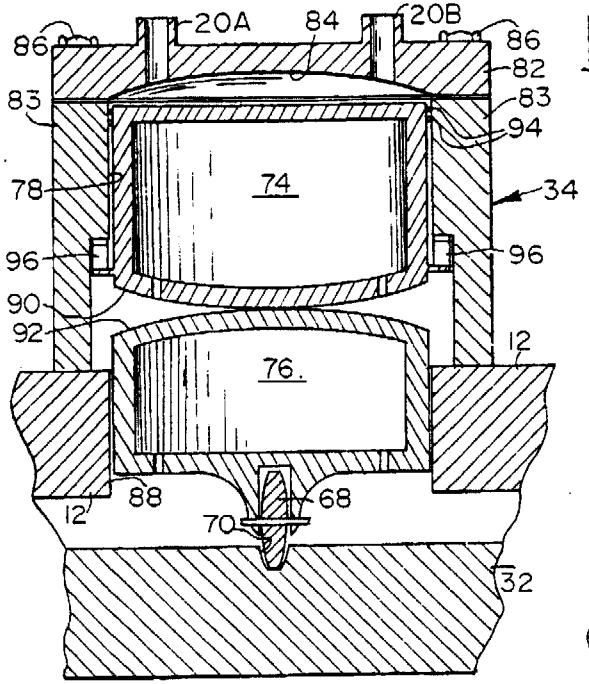
FIGS. 7 and 8 are enlarged fragmentary cross-sectional views of certain parts shown in FIG. 3.
Figure 11:
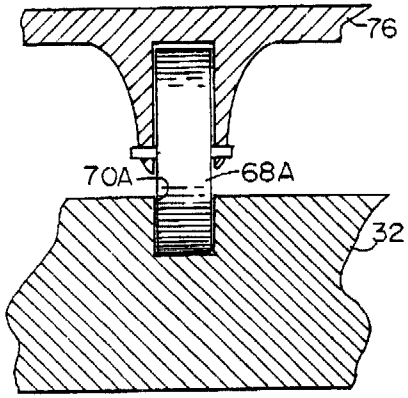
FIG. 11 is an enlarged fragmentary cross-sectional view of an alternate embodiment of certain parts shown in FIG. 7.
Figure 8:
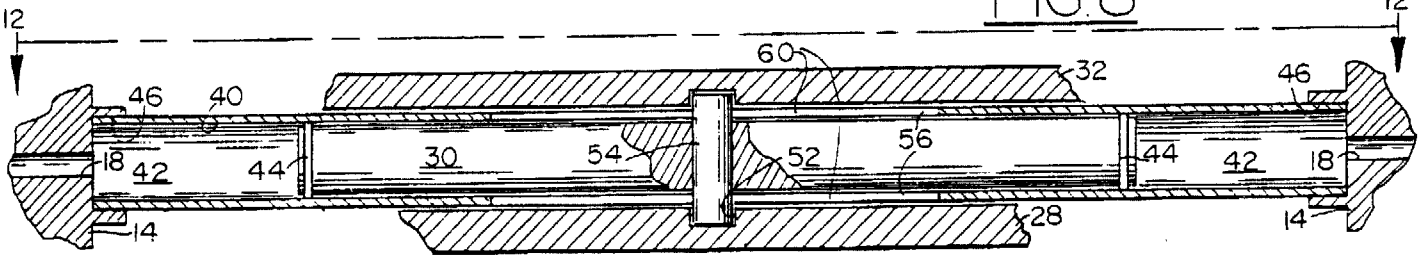

The track 70 is sized to provide for relatively small clearance between the sides of the track and the sides of the wheel 68 to prevent the wheel from rotating or twisting relative to the axis of the radial piston 34. Moreover, the track is preferably relatively deep to enhance retention of the wheel in the track. Preferably, the cross-section of the wheels and the side walls of the grooves are complimentary, such as being formed with generally concave profiles (not shown), generally convex profiles (FIG. 7), or generally rectangular profiles (FIG. 11). Thus, when the sleeve 32 rotates, the wheels roll along the track and rotate about an axis extending parallel to the shaft 22, the pistons are lifted or driven outwardly as the respective wheels roll over lobes 64, and the biasing force cause the pistons to reciprocate inwardly as the respective wheels roll into a valley in the track.

In the embodiment shown, a spring 96 such as a wave spring is positioned between the piston housing 80 and a shoulder 98 extending radially from the piston 34. The wave spring is adapted to continuously bias the piston radially inwardly to keep the wheel in rolling contact with the sleeve 32.

The radial pistons 34 shown are split into upper and lower piston members, 74 and 76, respectively, to provide for free-floating operation of the pistons. This provides for relatively low friction and reduces alignment problems associated with one-piece pistons when utilized as described herein.

The piston members 74, 76 are generally hollow to aid in responsive direction changes as the pistons reciprocate. The interior of the piston members are vented to accommodate changing temperatures. The upper piston member 74 is slidably disposed in a radially extending cylinder bore 78 formed in a piston housing 80. A cylinder head or cover 82 closes the outer end of the piston housing 80 and a gasket 83 seals the split line between the housing and the cover. The cover, the gasket, and the piston housing are secured to the pump housing 12 with screws 86. Thus, a variable volume chamber 84 is provided radially outwardly of the piston and within the piston housing. At least one seal ring 94 is preferably located in the upper piston member for sealing the lower portion of the chamber 84.

The lower piston member or piston base 76 is slidably located in a bore 88 formed in the main housing 12. The bore 88 extends radially inwardly from and is aligned with the cylinder bore 78 so that the upper and lower piston members 74, 76 are generally aligned with one another. By virtue of the spring 96 biasing the upper piston member toward the sleeve 32, the piston members are adapted to reciprocate together. Additionally, the bearing surfaces, 90 and 92, of the upper and lower piston members, 74 and 76, respectively, being preferably formed with a generally convex shape to reduce the friction between the two members as they reciprocate.

In the embodiment shown, the covers 82 are each provided with two ports 20A, 20B extending into the chambers 84. The ports are connected to the control manifold (not shown) which is adapted in a conventional manner to selectively control input and output flow to and from the chambers 84 in timed relation with the stroke of the radial pistons 34. It will be apparent to one skilled in the art that the pump 10 may be modified to include interconnecting fluid porting and control mechanisms for selectively controlling the flow of fluid into and out of the chambers 42, 84 without the need for a separate control manifold.

The sleeve 32 shown is formed from a solid piece of material. Alternately, to facilitate ease of manufacture, the sleeve may be formed, for example, by alternating cylindrical sleeve spacers and lobed sleeve members, each lobed member having a lobed track formed therein, and then securing the alternating sleeve members together. Advantageously, in either instance, the mass or rotational energy of the rotating sleeve 32 acts as a flywheel to smooth the intermittent and pulsating forces resulting from being driven by the axial pistons 30 and from driving the radial pistons 34 for pumping fluid through the chambers 84.

In the embodiment shown, twelve rows of radial pistons 34 are angularly spaced in the pump 10, each row having four pistons spaced axially along the pump. And the sleeve 32 is formed with six identical lobes 64 and six corresponding valleys 66, each lobe and valley being equally spaced on the periphery of the sleeve and extending longitudinally along the sleeve. As a result, the wheels 68 of each row of radial pistons simultaneously traverse the lobes and valleys, and the pistons in every second row operate simultaneously through the pumping cycle stroke.

To aid in assembly of the axial pistons 30 into the pump 10, optional lead-in slots 95 may be formed in the sleeves 28, 32; the slots 95 extending from the open ends of the sleeves, intersecting the grooves 52, 60, and being sized to slidably receive the ends of the guide pins 54. In this instance, the pistons 30 are initially positioned in the respective cylinders 40, and the pins 54 are pressed into centrally located openings in the pistons, or otherwise positioned extending from the pistons and through the slots 56. Then, with the sleeves 28 and 32 assembled into one end cap 14 and oriented vertically, the piston/cylinder assembly may be simply slid into position between the sleeves by sliding the pins along the lead-in slots 95 and into the grooves 52, 60. Alternately, for example, the pins 54 may be pressed into the centrally located opening in each piston after the pistons and cylinders have been positioned between the sleeves. In this instance, a pin may be inserted through an optional opening 97 formed in the sleeve 32 and through the slot 56 in the cylinder, and then pressed into the opening in the piston.

As will be apparent, the apparatus of the present invention is adaptable for use in other machines where conversion is generally needed between reciprocating linear motion and rotary motion. For example, the apparatus is adaptable for use as either a compressor, or an internal combustion engine. In the first instance, timing sequence of the control manifold may be modified to achieve the desired compression. Moreover, two or more pistons 30, 34 may be connected together in series to provide for multistage compression of the fluid before the fluid flows from the machine.

Figure 2:
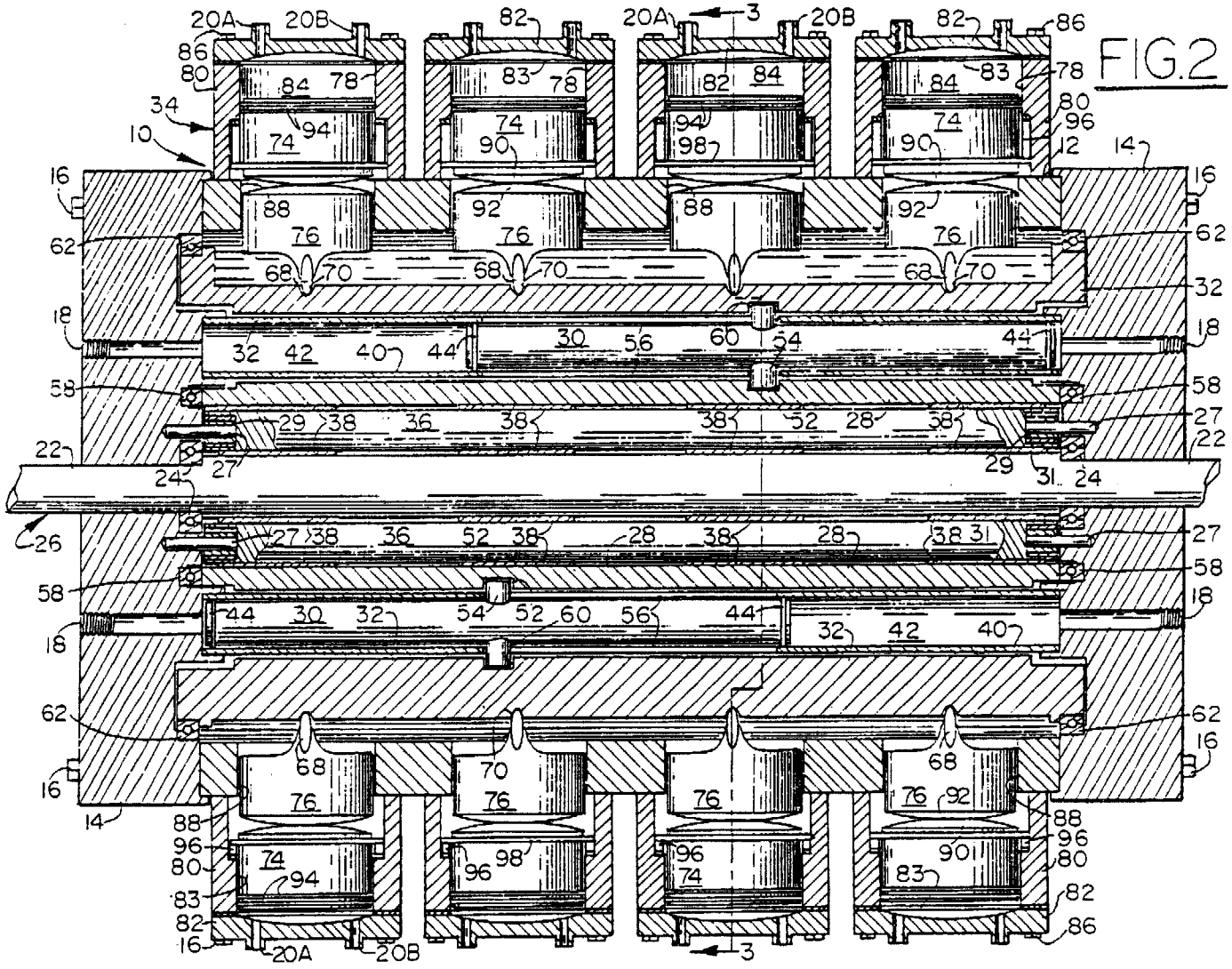
FIG. 2 is a cross-sectional view taken substantially along the line 2—2 of FIG. 1.
Figure 3:
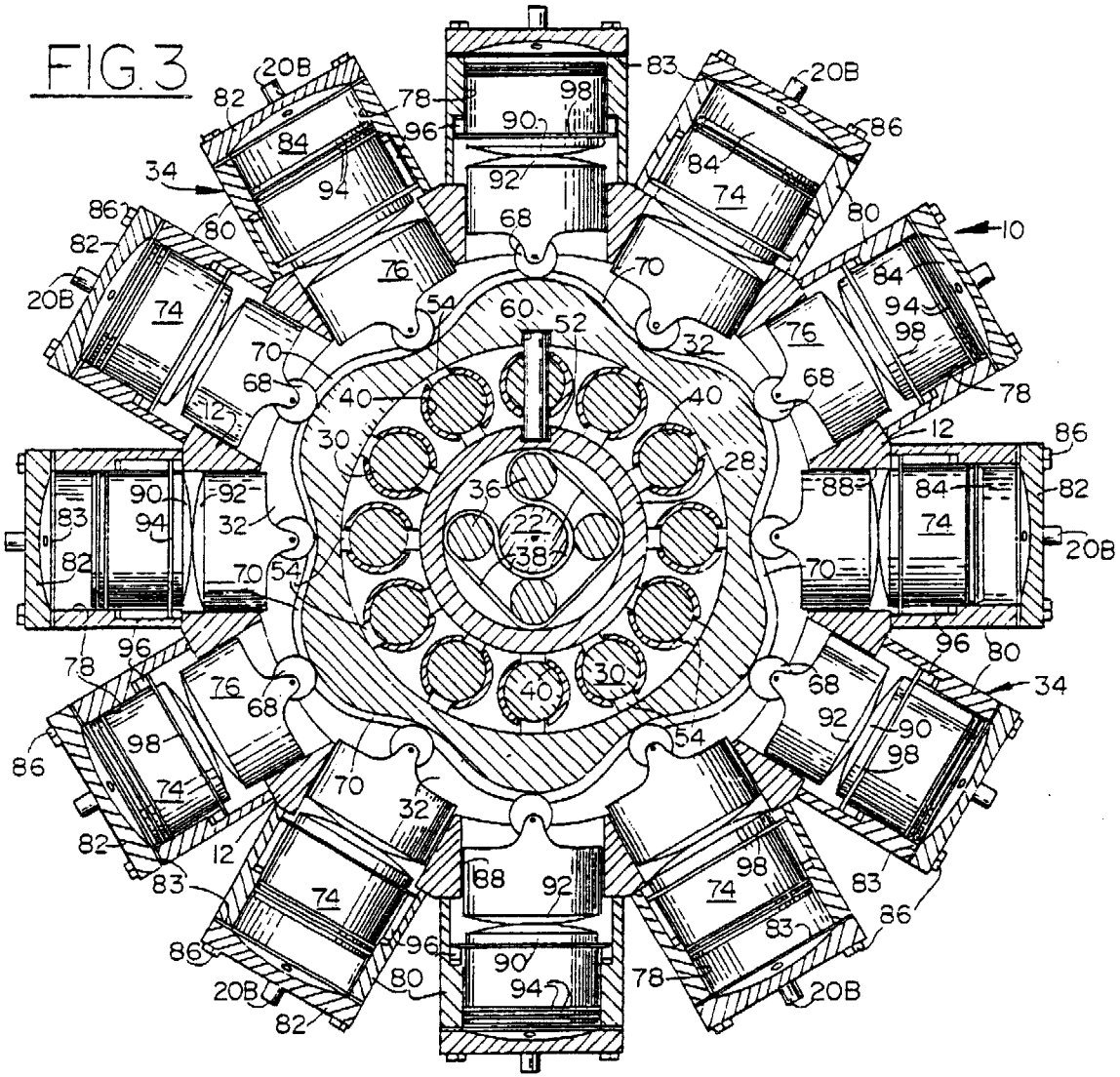
FIG. 3 is a cross-sectional view taken substantially along the line 3—3 of FIG. 2.
Figure 4:
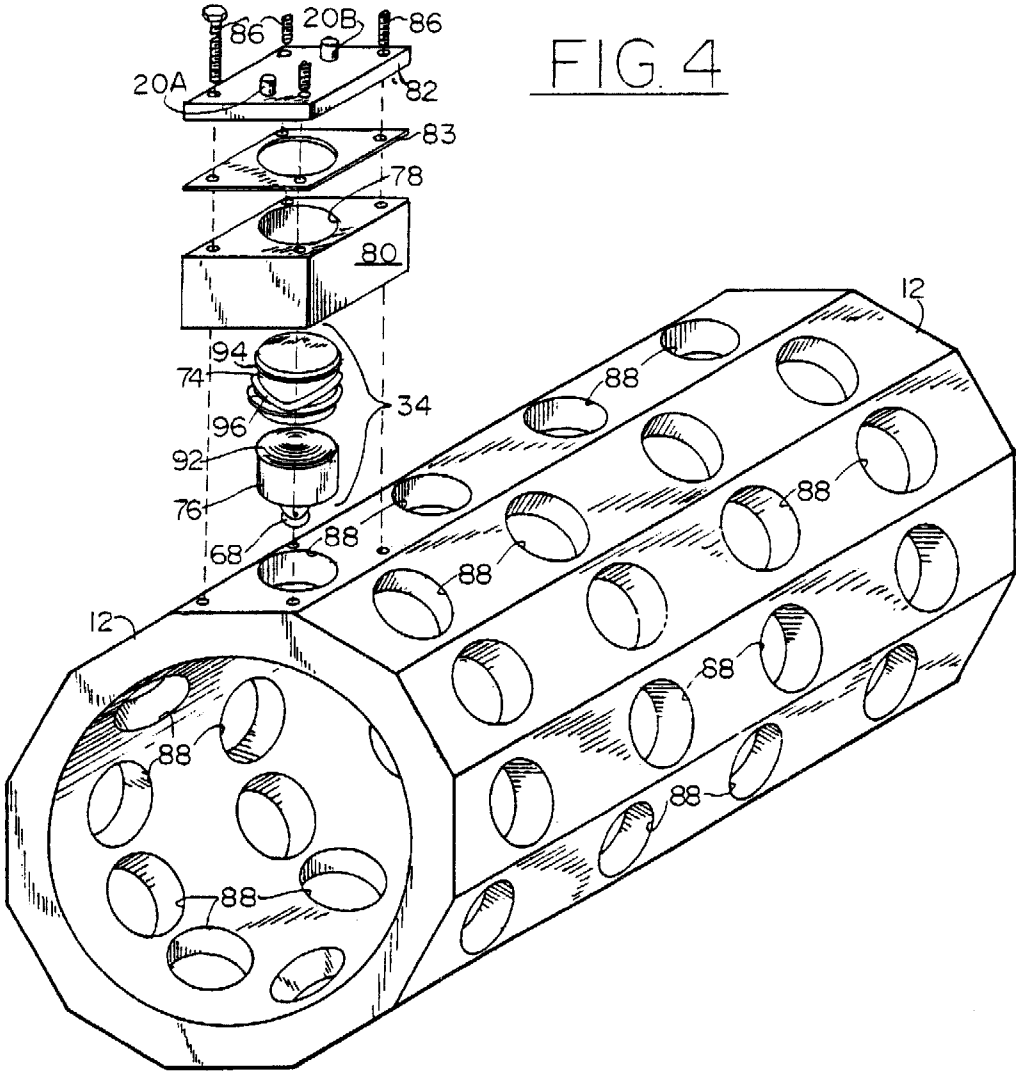
FIGS. 4–6 are enlarged perspective views of certain parts shown in FIG. 3.
Figure 5:
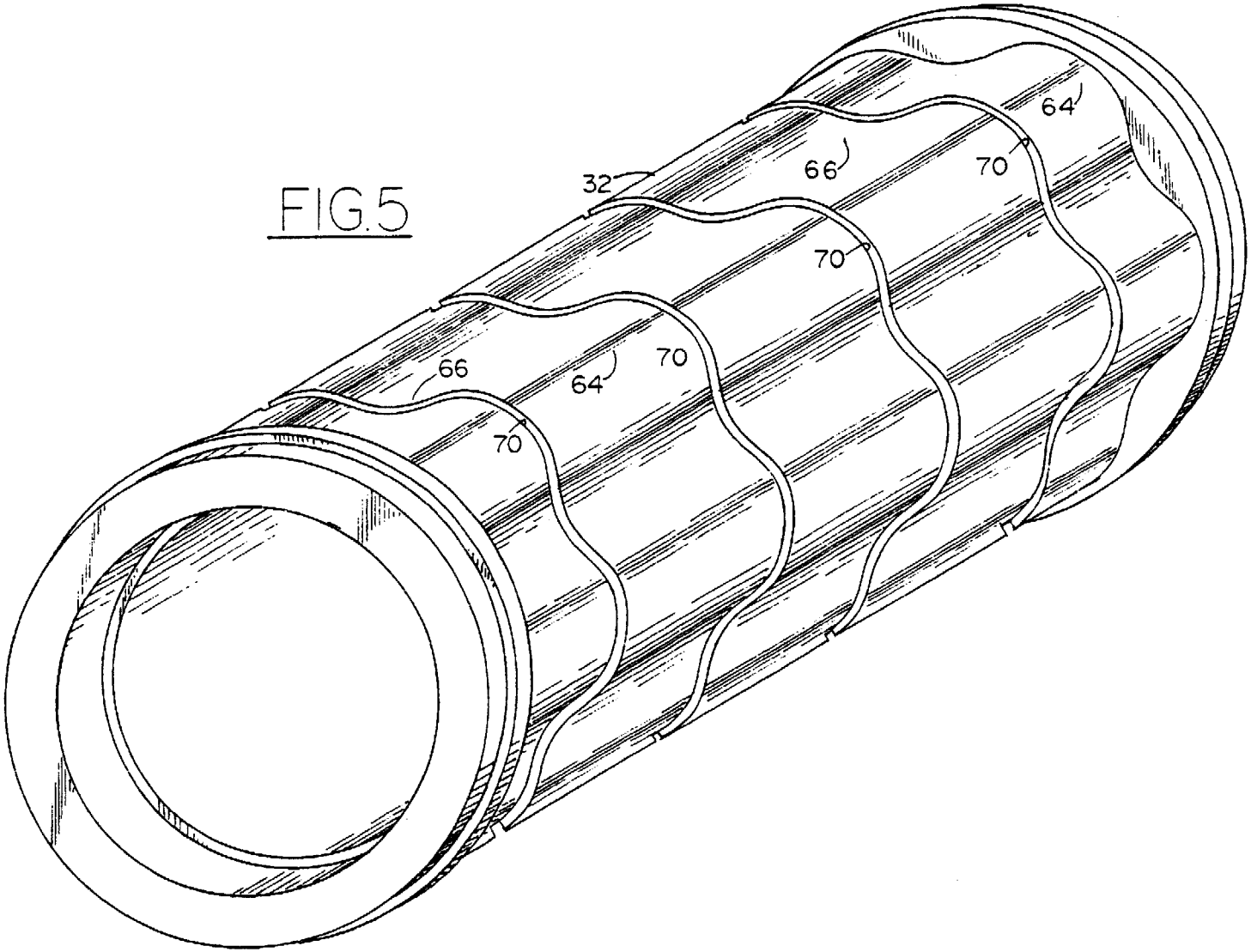

In an alternate embodiment (not shown), the apparatus as generally shown in FIGS. 1–3 is equipped with spark plugs in the chambers 84, and the sleeve 32 is modified to effect the timing of the radial pistons 34 so that the pistons are not simultaneously positioned at an end of a stroke. With such an arrangement, fuel may be introduced and burned in the chambers 84 in a conventional manner for producing rotary power output at the shaft 22. In this instance, the radial pistons 34 operate to rotationally drive the sleeve 32, with the axial pistons 30 reciprocating and transferring the torque to the sleeve 28 of the shaft assembly 26. Adding spark plugs, providing for both input and exhaust ports to the chambers 42, and burning fuel in the chambers enables the axial pistons to contribute to the rotary torque transmitted to the shaft assembly 26. Alternately, the axial pistons may be utilized in a pumping mode as described above.

Figure 15:
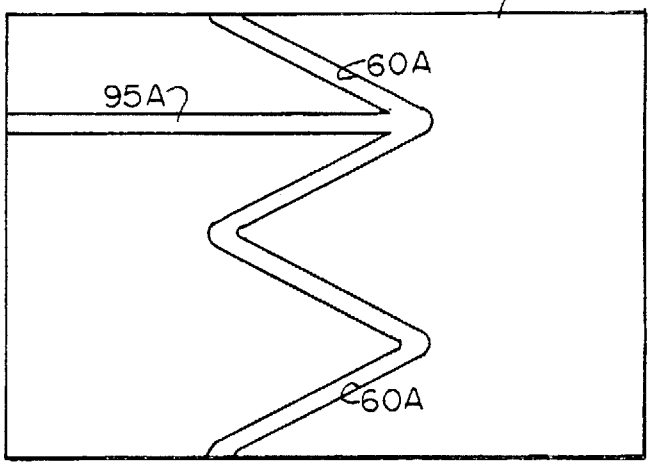
FIGS. 14 and 15 are views similar to FIGS. 3 and 9, respectively, of another alternate embodiment of the invention.
Figure 13:
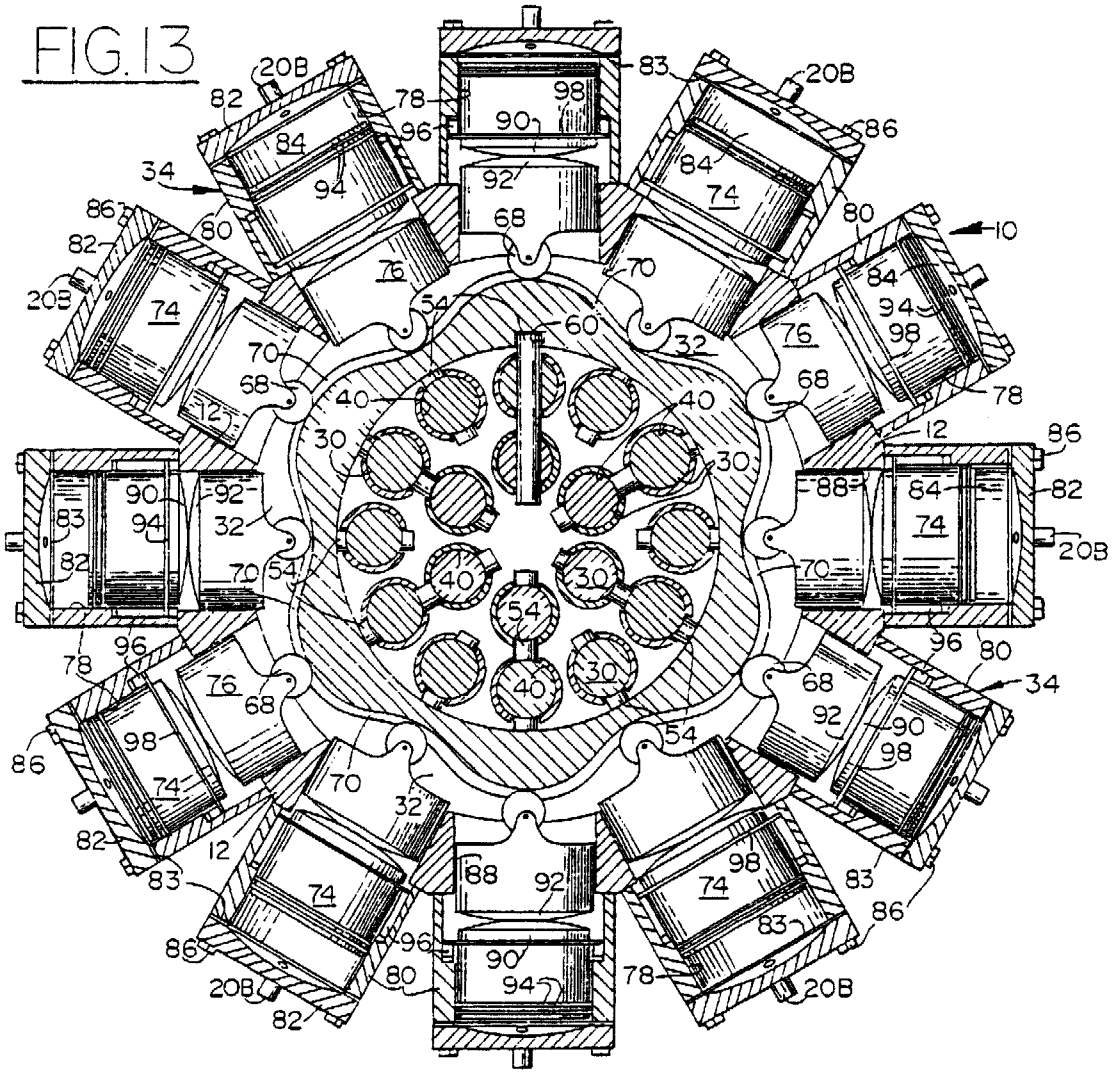
FIG. 13 is a cross-sectional view similar to FIG. 3 and of an alternate embodiment of the present invention.
Figure 14:
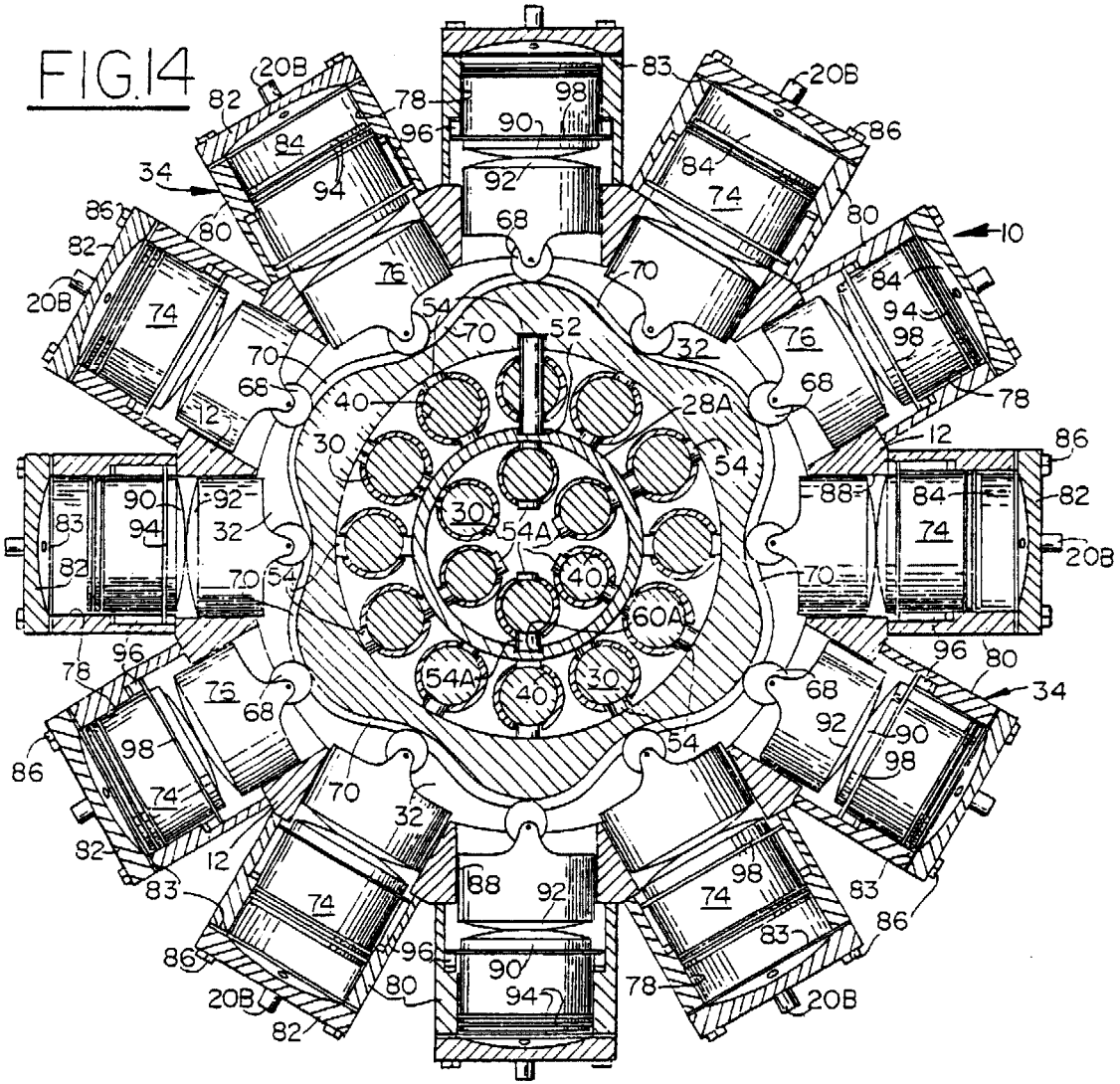

In a second alternate embodiment, the shaft assembly 26 of the pump 10 as generally shown in FIGS. 1–3 is removed and additional axial pistons are added in the space vacated by the shaft assembly. The machine 100 of this alternate embodiment is of similar construction to pump 10 but includes axial pistons 30 and cylinders 40 angularly spaced about two predetermined diameters as shown in FIG. 13, the cylinders being secured into the end caps 14 as generally provided for in the pump 10. In this embodiment, the inner axial pistons are angularly aligned with certain ones of the outer axial pistons, and the guide pins 54 extend through the aligned pistons such that the angularly aligned pistons will stroke together. Such an arrangement is particularly useful in those instances where the shaft 22 is not required for the transmission of either input or output torque. In such an arrangement, anti-rotation is preferably provided for the cylinders at the end caps 14 to enable the slots 56 in the cylinders to react side loading or torque on the drive pins resulting from sliding in the track 60. Alternately, a sleeve 28A (FIG. 14), mounted for rotation in the housing, and formed with tracks 60A (see FIG. 15) and 52 which are complimentary to the track 60 and which are located on the inside and outside diameters of the sleeve 28A, respectively, for slidably receiving pins 54A and 54, respectively, may be positioned between the inner axial pistons 30A and the outer axial pistons 30 for the conversion between reciprocating linear motion and rotary motion.

Advantageously, the apparatus of the present invention is also uniquely adaptable for simultaneous operation as any two or three of, for example, (a) an internal combustion engine, (b) a pump, or (c) a compressor. For example, in an environment where electric power is not available to drive a pump, but limited battery power is available, a machine as generally shown in FIGS. 1–3 may be adapted to burn a readily available fuel such as natural gas in a predetermined number of chambers 42, 84, with the remaining chambers being operable to pump or compress a fluid. In this instance, for example, the chambers 42 of the axial pistons 30 may be modified to include both inlet and exhaust ports and may be equipped with spark plugs extending therein for igniting the fuel. In such an arrangement, the axial pistons will reciprocate and drive the sleeve 32, so as to drive the pistons 34 in a pumping mode as previously described for pump 10. Advantageously, such an arrangement enables replacement of the drive shaft assembly with additional axial pistons in radial stacked relation (see FIG. 13) as discussed above in the second alternate embodiment.

It will also be apparent to one skilled in the art that the apparatus of the present invention may be adapted for use in other combinations of operating modes, the apparatus yet remaining similar and within the scope of the invention.

From the foregoing, it will be apparent that the present invention brings to the art new and improved apparatus for use in a pump 10, an internal combustion engine, a compressor, or like machinery. By virtue of the uniquely configured rotatable sleeve 32 disposed radially between and operably connecting axial pistons 30 and radial pistons 34, and the sleeve 28 which is responsive to rotary input for reciprocably driving the axial pistons, the pump 10 is uniquely adapted for the conversion between reciprocating linear piston motion and torque transmitting rotary motion within a relatively small space in the machine. As a result, the apparatus of the present invention enables provision for substantially increased piston chamber 42, 84 capacity when compared to prior machines of similar function and size, and in the present instance, enables provision for substantially increased pumping capacity when compared with similarly sized prior pumps.

I claim:

1. Apparatus for converting between rotary and linear motion, said apparatus comprising:

a plurality of radially reciprocable pistons disposed radially of a predetermined axis and angularly spaced in a plane extending perpendicular to said axis;

substantially hollow sleeve means disposed radially inwardly of said pistons and constrained for rotation about said axis; and repeating lobe means fixed to said sleeve means and angularly spaced in said plane, said lobe means and said pistons being operably coupled for simultaneous reciprocation of said pistons and rotation of said sleeve means.

2. Apparatus as defined in claim 1 in which said pistons include wheel means, and means for biasing said wheel means into rolling contact with said lobe means.

3. A machine as defined in claim 1 further comprising a plurality of axially reciprocable pistons disposed radially inwardly of said sleeve means, said sleeve means and said axial pistons being operably connected such that said axial pistons are reciprocably responsive with rotation of said sleeve means.

4. Apparatus as defined in claim 3 in which the inside surface of said sleeve means includes a cam track formed therein, said axial reciprocable pistons being operably connected with said cam track such that said axial pistons are reciprocably responsive with rotation of said sleeve means.

5. Apparatus as defined in claim 1 further comprising power conversion means radially inwardly of said sleeve means and operatively coupled to one of said sleeve means and said radial pistons.

6. Apparatus for converting between rotary and linear motion, said apparatus comprising:

a generally cylindrical member constrained for rotation about a predetermined axis, said member having outer and inner diameter surfaces and having first and second cam track means formed in said outer and inner surfaces, respectively; and first and second plurality of axially reciprocable pistons disposed radially outwardly and inwardly, respectively, of said cylindrical member;

said first and second plurality of pistons being operably connected to said first and second cam track means, respectively, for simultaneous rotation of said cylindrical member and linear axial reciprocation of said pistons.

7. Apparatus for converting between rotary and linear reciprocating motion, said apparatus comprising:

shaft means constrained for rotation about a predetermined axis, said shaft means having an outer diameter formed with a first cam means;

sleeve means coaxial with said shaft means and constrained for rotation about said axis, said sleeve means having an inner diameter surface with a second cam means; and a plurality of axially reciprocable pistons disposed radially between said shaft means and said sleeve means, said pistons being operably connected between said first and second cam means for simultaneous rotation of said shaft means and said sleeve means and linear reciprocation of said pistons.

8. Apparatus as defined in claim 7 further comprising a plurality of radially reciprocable pistons disposed radially outwardly of and operatively connected to said sleeve means.

9. Apparatus as defined in claim 8 in which the outside diameter portion of said sleeve means is formed with repeating lobe means, and said radial pistons are operatively associated with said lobe means.

10. A machine comprising:

a plurality of radially reciprocable members angularly spaced and disposed radially about a predetermined axis;

a plurality of axially reciprocable members angularly spaced on a predetermined diameter about said axis; and a sleeve member constrained for rotation about said axis and disposed between said radial members and said axial members, said sleeve being in torque transmitting connection with said radial and said axial members.

11. A machine as defined in claim 10 in which said sleeve member is formed with continuous but repeating cam track means operably engaging said axial members for effecting said torque transmitting connection therebetween, said sleeve member further having angularly repeating cam lobe means operably engaging said radial members for effecting said torque transmitting connection therebetween.

12. A machine as defined in claim 10 in which said axial members are located radially inwardly of said sleeve, in which said cam track means is formed on the inside diameter of said sleeve, and in which said cam lobe means is formed on the outside portion of the sleeve.

13. A machine as defined in claim 10 in which said axial members include guide pins extending radially into said cam track means, said cam track means being formed having a generally Fourier shape.

14. A machine as defined in claim 10 and adapted for use in a pump, a compressor, an internal combustion engine, or like machinery, each of said radial members being slidably disposed in a variable volume chamber utilized for one of pumping a fluid, compressing a fluid, and burning a fuel.

15. A machine as defined in claim 10 in which said radial members include wheel means, and means for biasing said wheel means into rolling contact with said lobe means.

16. A machine as defined in claim 15 in which said radial members include outer and inner members, said outer member being slidably disposed in a cylinder for free rotation therein, engagement between said outer and inner members being maintained by said biasing means.

17. A machine as defined in claim 10 further comprising a plurality of axially reciprocable members angularly spaced on a second predetermined diameter about said axis, said members on said second diameter being operably and reciprocably interconnected with said members on said first diameter.

18. A machine as defined in claim 17 in which each of said members on said second diameter are fixed to one of said members on said first diameter for simultaneous reciprocation of said two members.

19. Apparatus adapted for use in a pump, a compressor, an internal combustion engine, or like machinery, said apparatus comprising:

a housing;

shaft means journaled in the housing for rotation about a predetermined axis;

a plurality of axially extending cylinders connected to said housing and disposed radially of said axis on a first predetermined diameter;

a plurality of axially reciprocable pistons slidably disposed in said cylinders and defining variable volume axial chambers there in;

a plurality of radially extending cylinders connected to said housing and disposed radially of said axis on a second predetermined diameter;

a plurality of radially reciprocable pistons slidably disposed in said radial cylinders and defining variable volume reciprocal chamber there in; and sleeve means rotatably mounted in said housing and disposed between said first and second diameters;

said shaft means having first cam track means operably engaging said axial pistons in torque transmitting relation for simultaneous reciprocation of said axial pistons and rotation of said shaft means, said sleeve means having second track means operably engaging said axial pistons and having cam lobe means operably engaging said radial pistons for simultaneous (A) reciprocation of said axial pistons, (B) reciprocation of said radial pistons, and (C) rotation of said sleeve means.

20. Apparatus as defined in claim 19 in which said axial pistons are located radially outwardly from said shaft means, said first cam track means being formed on the outside diameter portion of said shaft means.

21. Apparatus as defined in claim 20 in which said axial pistons are located radially inwardly of said sleeve, said second cam track means being formed on the inside portion of said sleeve and said cam lobe means being formed on the outside portion of the sleeve.

22. Apparatus as defined in claim 21 in which said axial pistons include guide pins extending radially into said cam track means, said cam track means being formed having a generally Fourier shape.

23. Apparatus as defined in claim 22 in which said radial pistons include wheel means, and means for biasing said wheel means into rolling contact with said lobe means.

* * * * *